US006828716B2

(12) United States Patent
Kang

(10) Patent No.: US 6,828,716 B2
(45) Date of Patent: Dec. 7, 2004

(54) SHADOW MASK FOR COLOR CRT

(75) Inventor: Su Dong Kang, Gumi-si (KR)

(73) Assignee: LG. Philips Displays Korea Co., Ltd., Gyeongsangbuk-do (KR)

( * ) Notice: Subject to any disclaimer, the term of this patent is extended or adjusted under 35 U.S.C. 154(b) by 210 days.

(21) Appl. No.: 10/317,149

(22) Filed: Dec. 12, 2002

(65) Prior Publication Data

US 2003/0209964 A1 Nov. 13, 2003

(30) Foreign Application Priority Data

May 10, 2002 (KR) ..... 2002-25841
May 13, 2002 (KR) ..... 10-2002-0026221

(51) Int. Cl.[7] ..... H01J 29/07
(52) U.S. Cl. ..... 313/407; 313/402
(58) Field of Search ..... 313/402, 403, 313/404, 407

(56) References Cited

U.S. PATENT DOCUMENTS 4,327,307 A * 4/1982 Penird et al. ..... 313/407
4,562,377 A * 12/1985 Kamohara et al. ..... 313/402
6,545,400 B2 * 4/2003 Ito et al. ..... 313/402
6,630,776 B2 * 10/2003 Nakayama et al. ..... 313/407
2002/0010772 A1 * 1/2002 Kusano ..... 709/223
2002/0158562 A1 * 10/2002 Okamoto et al. ..... 313/407

* cited by examiner

*Primary Examiner*—Ashok Patel
(74) *Attorney, Agent, or Firm*—Birch, Stewart, Kolasch & Birch, LLP

(57) ABSTRACT

A color cathode ray tube including a generally rectangular shadow mask having a curved aperture portion having a multiplicity of electron-transmissive apertures, a curved imperforate portion surrounding and integral with said apertured portion and a skirt portion being bent back from a periphery of said curved imperforate portion; said skirt portion being provided with a plurality of embossments and a plurality of: (a) tilted slits or (b) a plurality of tilted slits with bridge.

19 Claims, 13 Drawing Sheets

(Long side)

(Short side)

(Present invention)

SHADOW MASK FOR COLOR CRT

BACKGROUND OF THE INVENTION

1. Field of the Invention

The present invention relates generally to a shadow mask for a color cathode ray tube, and more particularly to a shadow mask for a color cathode ray tube having a modified shape and arrangement of slits, and embossments of a skirt portion of the shadow mask.

2. Description of the Related Art

As a main element for realizing pictures in a picture display apparatus such as a television receiver or a computer monitor, a color cathode ray tube (CRT) is a device for realizing color pictures by emitting light from fluorescent substance in a fluorescent screen including R, G and B fluorescent substance patterned in an inner side of a panel, which is a front body of the CRT, by means of electron beam controlled by picture signals.

FIG. 1 is a partial sectional view showing a structure of a general color CRT.

Referring to FIG. 1, the color CRT generally comprises a panel 1 having a roughly rectangular shape and arranged in the front of the color CRT and a funnel 2 having a roughly conical shape and arranged in the rear of the panel 1.

In addition, in an inner space formed by the panel 1 and the funnel 2, the color CRT further includes a fluorescent screen 4 for emitting light, an electron gun 12 provided within a neck 13 of the funnel 2 for projecting electron beam 6 for emitting light from the fluorescent screen 4, a shadow mask 3 for selecting color so that light is emitted from the fluorescent screen 4, a frame assembly 7 for supporting the shadow mask 3 by applying tension to it, a spring 8 for coupling the frame assembly 7 to the panel 1, an inner shield 9 welded and fixed to the frame assembly 7 for shielding an external earth magnetic field, and a reinforcement band 11 for provided at a circumference of a side portion of the panel 1 for preventing an external impact.

In addition, outside the neck 13 of the funnel 2 is provided a deflection yoke 5 for deflecting the electron beam 6 projected from the electron gun 12 in various directions, i.e., up, down, left and right and 2, 4 and 6-pole magnets for correcting a traveling locus of the projected electron beam 6 so that the projected electron beam 6 is precisely hit on prescribed fluorescent substance for the purpose of preventing the badness of color purity.

Now, as a main element in connection with the present invention, the shadow mask 3 will be in detail explained.

FIG. 2 is a front sectional view of the shadow mask 3.

Referring to FIG. 2, the shadow mask 3 made of thin metal film having a thickness of about 0.1 to 0.12 mm is a portion positioned opposite the fluorescent screen 4. The shadow mask 3 is completed by punching a circle plate with a plurality of electron beam through holes 110 formed by an etching process into a prescribed shape, pressing the punched plate into a curve shape such that it has same curve as a screen of the panel 1, and forming a skirt portion 130 to be welded to the frame assembly 7 by bending four sides of the curve shape by 90 degree.

Herein, the steps of pressing and bending are continuously performed in a single process.

Therefore, the shadow mask 3 includes a porous portion 100 having a curved shape, a nonporous portion 120 connected adjacent to the porous portion 100 and having a curved shape, and the skirt portion 130 bent backward from a periphery of the nonporous portion 120.

In the shadow mask 3 formed as above, the so-called "spring back" due to a property of material is generated in the skirt portion 130. Accordingly, the skirt portion is bent in a spaced direction from an outside direction. That is, when a specific time elapses after pressing the skirt portion 130 by use of a presser, the skirt portion 130 becomes wider at an initial position with a specific interval. Under such a condition, when the skirt portion 130 is fixed to the frame assembly 7, a deformation due to the bend of the skirt portion 130 is generated in a part of the porous portion having the curved shape (hereinafter referred to as "a curved portion") of the shadow mask 3. In this way, as the skirt portion 130 becomes more widened, a support force for supporting the curved portion become more weakened, which results in decrease of a strength of the curved portion of the shadow mask 3. In addition, due to a close pressing to the shadow mask 3 by an amount of the widened of the skirt portion, a repulsive force is applied to the curved portion, which results in a variation of a curvature of the curved portion.

As a solution for the above problems, Korean patent application No. 10-1998-0008030 (published on Nov. 25, 1998, with publication No. 1998-0080110) is disclosed, which will be explained below.

FIG. 3 is a side sectional view of long and short sides of a shadow mask in the published patent application.

Referring to FIG. 3, a skirt portion (130 in FIG. 2) of the shadow mask has a plurality of pairs of embossments 200 and 300 and slit 210 and 310 having a prescribed shape and formed alternately in parallel, with one of the plurality of pairs of embossments positioned at both sides on the basis of central lines of the long and short sides.

By absorbing surplus material remaining after performing the steps of pressing and bending the shadow mask, the slits 210 and 310 and the embossments 200 and 300 formed in the skirt portion 130 are intended to substantially reduce a tendency of returning to an initial shape of the skirt portion 130, reduce a curl generated in the skirt portion 130, and minimize the occurrence of curl into a comparatively small region over the whole periphery of the skirt portion.

As shown in FIG. 3, however, the slits 210 and 310 and the embossments 200 and 300 in the skirt portion 130 of the conventional shadow mask 3 are configured to be positioned erectly and alternately in parallel with a specific interval. Thus, since the erected slits 210 and 310 and the embossments 200 and 300 undertake all amount of curl of the skirt portion 130 generated in a crossing direction upon forming the shadow mask 3, they do not have a strength sufficient to absorb a compression force applied upon forming the shadow mask, which results in excessive creases in the slits 210 and 310 and the embossments 200 and 300 and a deformation of contour of the curved shape of the shadow mask 3.

Typically, after a CRT is manufactured using a conventional shadow mask 3 as shown in FIG. 1, the CRT is subject to various kinds of reliability tests including, particularly, a falling test as a strength test. The falling test is a test for checking whether the shadow mask is deformed when the CRT is fallen from a specific height.

If an impact on the fallen CRT is weak in the falling test, the shadow mask 3 returns immediately to its original state though it is slightly deformed. In contrast, if the impact is strong, the shadow mask 3 cannot return to the original state due to a deformation such as a distortion of a portion of its surface caused while it is largely vibrated up and down.

The above problem involves with various causes, particularly, a structure of the shadow mask 3. In other words, the slits 210 and 310 and the embossments 200 and 300 in the skirt portion 130 of the shadow mask 3 cannot endure the impact in the falling test due to failure of a proper dispersion of load, which results in a serious deformation of the shadow mask.

When such a plastic deformation is generated in the shadow mask, the electron beam 6 emitted from the electron gun 12 can collide with the shadow mask since it cannot properly pass through the electron beam through holes of the shadow mask 3, which results in a deterioration of the shadow mask. In addition, the electron beam 6 cannot properly hit the fluorescent substance on the fluorescent screen 4 of the panel 1, which results in a badness of the picture on the screen and hence a deterioration of productivity.

In addition, for an acoustic impact test, vibration of the shadow mask cannot be sufficiently absorbed, which results in a serious vibration of the picture on the screen and a deterioration of a strength of the shadow mask.

In summary, conventionally, the slits 210 and 310 and the embossments 200 and 300 each having a prescribed shape are placed in a parallel and alternate manner in order to minimize the amount of curl being an amount of spring-back of the skirt portion 130 of the shadow mask 3. However, such a conventional structure for shadow mask has a limitation on reduction of the spring-back and is insufficient to prevent a deterioration of the strength of the shadow mask.

Accordingly, there is a need for a new shadow mask having a higher strength.

SUMMARY OF THE INVENTION

Accordingly, the present invention has been made keeping in mind the above problems occurring in the prior art, and an object of the present invention is to provide a shadow mask for a color CRT whose strength is increased and whose curve distortion is reduced by inclining angles of a plurality of slits formed in a skirt portion of a shadow mask.

Another object of the present invention is to provide a shadow mask for a color CRT in which an amount of curl in a skirt portion of the shadow mask is minimized and a curve distortion of the shadow mask is prevented by an increase of a strength of the shadow mask by forming prescribed bridges in a plurality of slits provided in the skirt portion of the shadow mask including the plurality of slits and a plurality of embossments or inclining angles of the plurality of slits in which the bridges are formed.

Through the above objects, the present invention has an eventual object of improving a quality of picture and a productivity of the CRT.

In order to accomplish the above objects, the present invention provides a color cathode ray tube including a generally rectangular shadow mask having a curved apertured portion having a multiplicity of electron-transmissive apertures, a curved imperforate portion surrounding and integral with said apertured portion and a skirt portion being bent back from a periphery of said curved imperforate portion; said skirt portion being provided with a plurality of tilted slits and a plurality of embossments.

In addition, the present invention provides a color cathode ray tube including a generally rectangular shadow mask having a curved apertured portion having a multiplicity of electron-transmissive apertures, a curved imperforate portion surrounding and integral with said apertured portion and a skirt portion being bent back from a periphery of said curved imperforate portion; said skirt portion being provided with a plurality of tilted slits with bridge and a plurality of embossments.

In addition, the present invention provides a color cathode ray tube including a generally rectangular shadow mask having a curved apertured portion having a multiplicity of electron-transmissive apertures, a curved imperforate portion surrounding and integral with said apertured portion and a skirt portion being bent back from a periphery of said curved imperforate portion; said skirt portion being provided with a plurality of tilted slits with bridges are tilted from the vertical position toward a direction of the end portion of the skirt portion.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Preferred embodiments of the present invention will now be described in detail with reference to the accompanying drawings.

Figure 2:
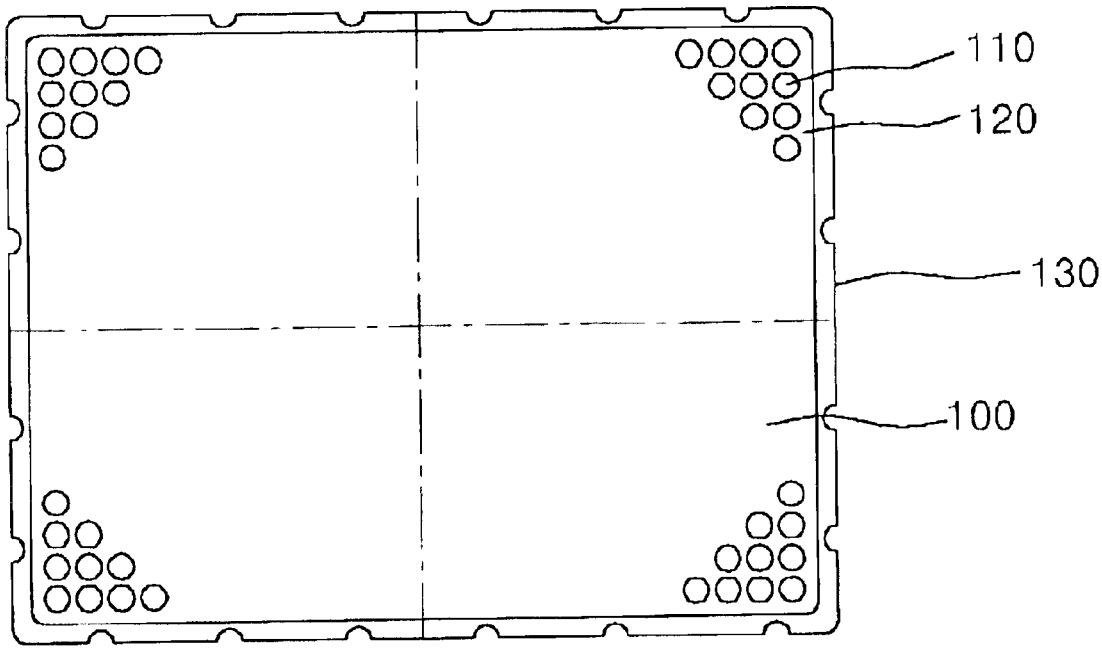
FIG. 2 (Related Art)
FIG. 2 is a front sectional view of a conventional shadow mask.
Figure 3:
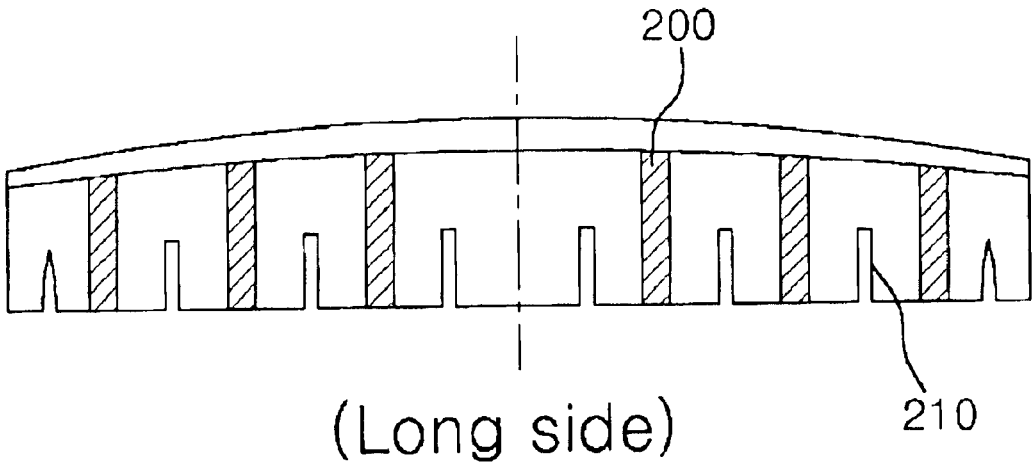
FIG. 3 (Related Art)
FIG. 3 is a side sectional view of long and short sides of a conventional shadow mask.
Figure 3:
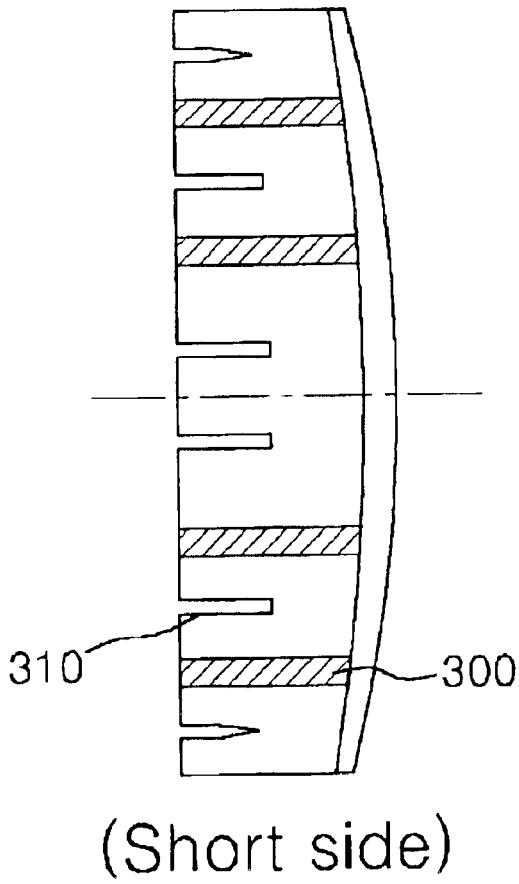
FIG. 3 (Related Art)

In the preferred embodiments of the present invention, since only slits in a skirt portion 130 are modified, a front sectional view of a shadow mask of the present invention is similar to FIG. 2 showing the front sectional view of the conventional shadow mask.

Figure 4:
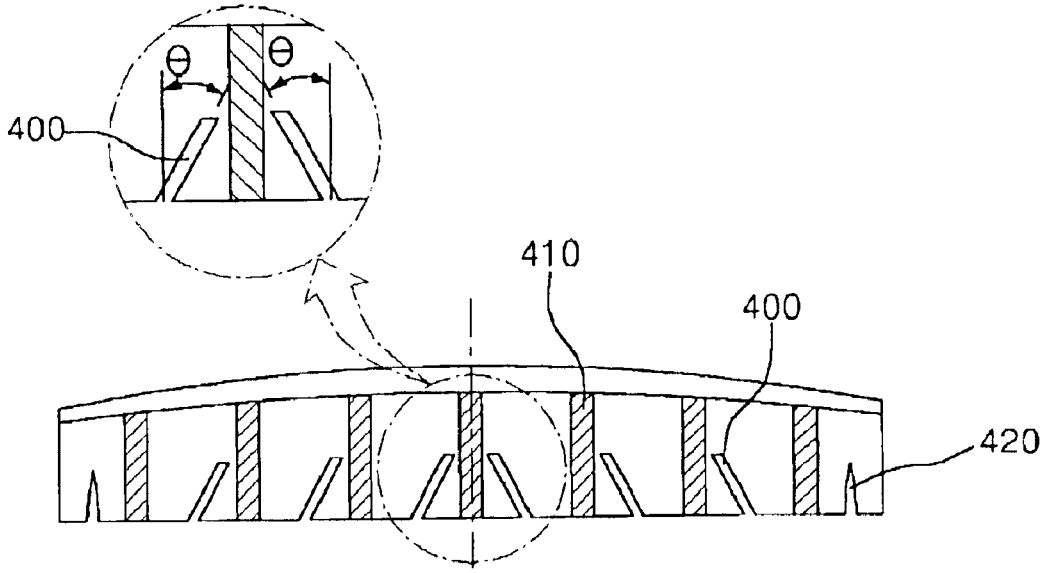
FIG. 4 is a side sectional view of long and short sides of a shadow mask according to a preferred embodiment of the present invention.
Figure 4:
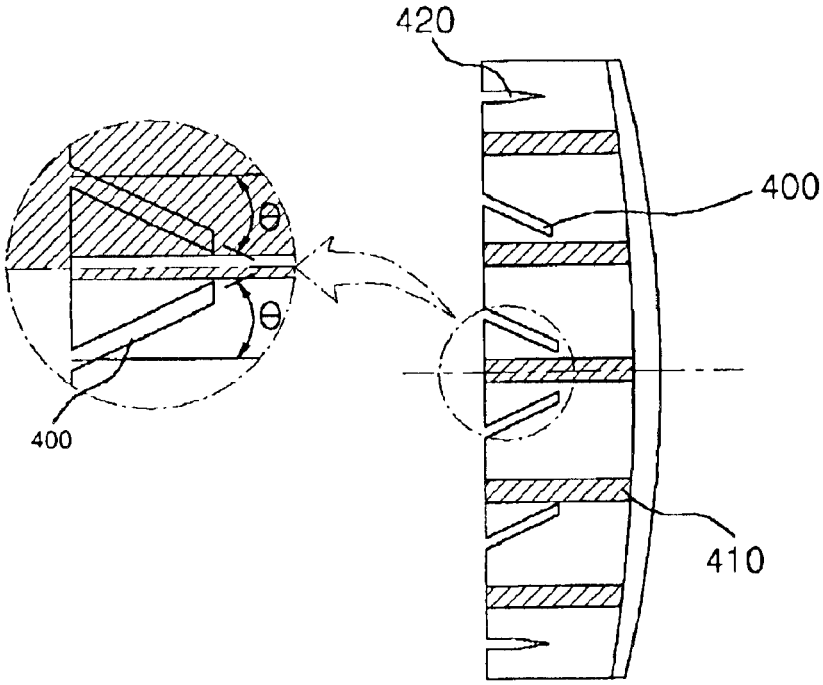

FIG. 4 is a side sectional view of long and short sides of a shadow mask according to a preferred embodiment of the present invention.

Referring to FIG. 4, the shadow mask according to a preferred embodiment of the present invention will be described.

In the side sectional view of FIG. 4, a long portion having a prescribed thickness and forming a slightly curved surface represents a shape of a curve surface of the shadow mask. One of a plurality of embossments 410 indented, with an arched shape, into a central internal portion in the skirt portion (130 in FIG. 2) of the shadow mask is arranged in a center of each of long and short sides of the skirt portion. A pair of slits of a plurality of slits are arranged in a center of each of long and short sides of the skirt portion with a prescribed interval in both sides of one embossments 410. Then, the plurality of slits 400 are inclined toward the embossments 410 being a central axis of each of the long and short sides with a prescribed angle with respect to a direction of an end portion of the skirt from a direction of height of the skirt of the shadow mask. The plurality of slits 400 inclined at the prescribed angle and the remaining of the plurality of embossments 410 are arranged in an alternate and parallel manner.

More particularly, if the prescribed angle θ of the plurality of slits 400 lies between 60° and 90° in the direction of an end portion of the skirt from the direction of height of the skirt of the shadow mask, when the skirt portion 130 of the shadow mask is bent, many creases occur in the slits and a remarkable improvement effect for the spring-back and the strength of the shadow mask cannot be achieved. However, if the angle θ of the slits 400 continues to be modified to lie between 30° and 60° in the direction of an end portion of the skirt from the direction of height of the skirt of the shadow mask, the shadow mask having a high strength, a reduced deformation and a reduced curl can be obtained when the shadow mask is formed.

At this time, in order to prevent folding of a diagonal corner of the shadow mask when the shadow mask is formed, slits 420 at both ends of the long and short sides of the skirt portion are arranged without any inclination.

In practicing the present invention, preferably, the plurality of slits 400 are formed by 20%–60% of entire height of the skirt portion from the end portion of the skirt portion and the plurality of embossments 410 are formed over the entire height of the skirt portion.

Figure 1:
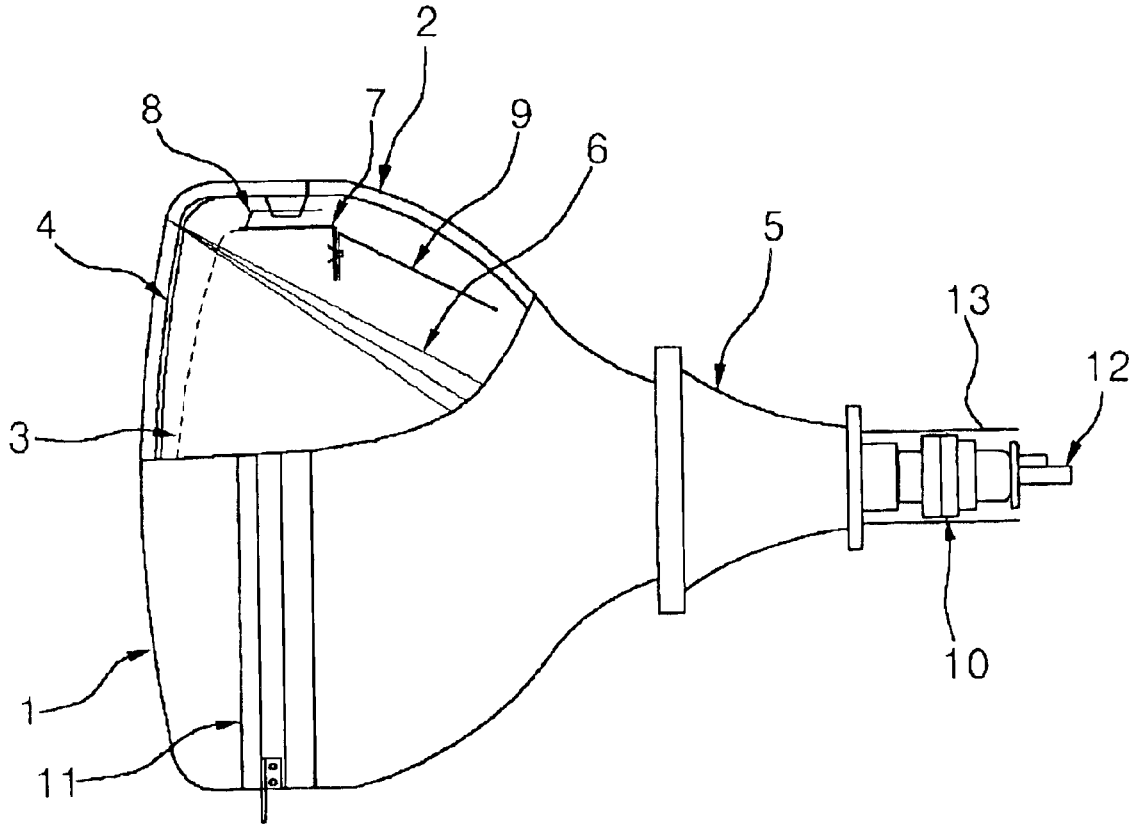
FIG. 1 (Related Art)
FIG. 1 is a sectional view of a general CRT on which a conventional shadow mask is mounted.

The reason of such a formation is that if the slits 400 are formed at a too low location, a curl prevention effect in the skirt portion of the shadow mask is low and a strength improvement of the shadow mask cannot be achieved up a desired level, in contrast, if the slits 400 are formed at a too high location above 60% of the entire height of the skirt portion, a stress generated in the skirt portion when the shadow mask is fitted into the frame assembly (7 in FIG. 1) cannot be properly dispersed and hence is transmitted up to the porous portion having a curved shape, which results in a deformation of the porous portion of the shadow mask to be used in future.

Figure 5:
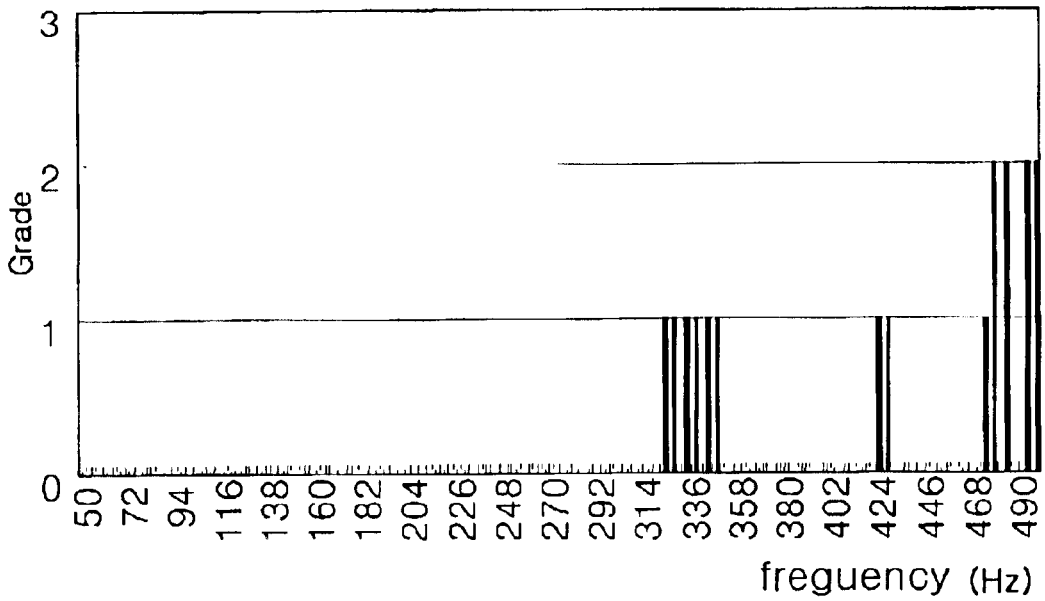
Fig. 5 (Prior art)
FIG. 5 is a graph showing a result of improvement of a howling characteristic according to a preferred embodiment of the present invention, compared with a conventional result.
Figure 5:
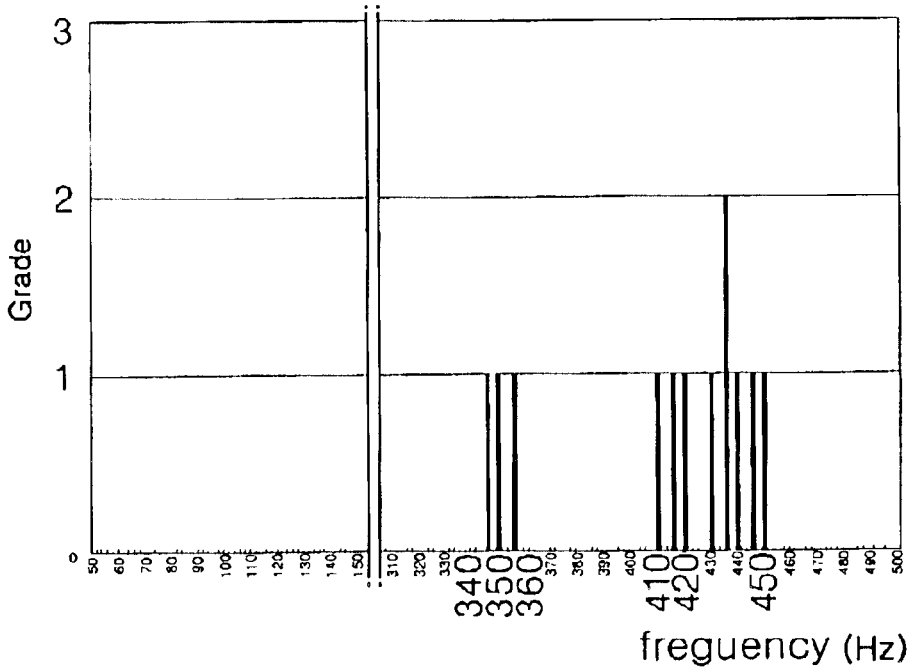
Fig. 5 (Prior art)

FIG. 5 is a graph showing a result of improvement of a howling characteristic according to a preferred embodiment of the present invention, compared with a conventional result.

Herein, a horizontal axis indicates a frequency Hz and a vertical axis indicates a grade of a howling characteristic.

Grade 1 indicates that the howling characteristic is fine, grade 2 indicates that ¼ of a picture is shivered, and grade 3 indicates that the howling characteristic is wrongest. Namely, a higher grade means a wronger howling characteristic.

Referring to FIG. 5, it can be seen that a proportion of grade 2 in the present invention is certainly decreased compared to the prior art.

Therefore, it can be seen that the preferred embodiment of the present invention considerably improves a picture shivering phenomenon compared to the prior art.

In addition, a Doming characteristic is conventionally 7–11 μm in three and nine o'clock directions, but is 6–8 μm in three and nine o'clock directions and 4 μm in a two o'clock direction in the present invention. This shows that the Doming characteristic improves by a comparative decrease of its value.

On the other hand, although one of the plurality of embossments is located at the center axis of the long and short sides of the skirt portion of the shadow mask in the preferred embodiment of the present invention, it is possible to locate a pair of slits at both sides of the center axis without an embossments, arrange the plurality of embossments and the remaining slits in the alternate and parallel manner, and then arrange the plurality of slits symmetrical with respect to the center axis to be inclined toward a center point.

In addition, although the present invention illustrates, as an example, the shadow mask including the skirt portion having a structure in which the slits forming six bridges are arranged in the long side of the skirt portion and the slits forming four bridges are arranged in the short side of the skirt portion in the alternate and parallel manner, such a structure can be varied depending on a size of a screen, and therefore, the principle of the present invention is applicable to a shadow mask for a color CRT having different number of the slits and/or embossments.

In addition, it is preferred that the panel has a substantially flat outer surface and a curved inner surface.

<Another Preferred Embodiment>

Another preferred embodiment of the present invention provides a shadow mask 3 comprising a porous portion 100 with a curved shape including a plurality of beam through holes 110, a nonporous portion 120 with a curved shape connected adjacent to the porous portion 100, and a skirt portion 130 bent backward from a periphery of the porous portion 100 and including a plurality of slits 500, 600 and 700 forming bridges as strength enhancing means and a plurality of embossments 520, 620 and 720.

Figure 6:
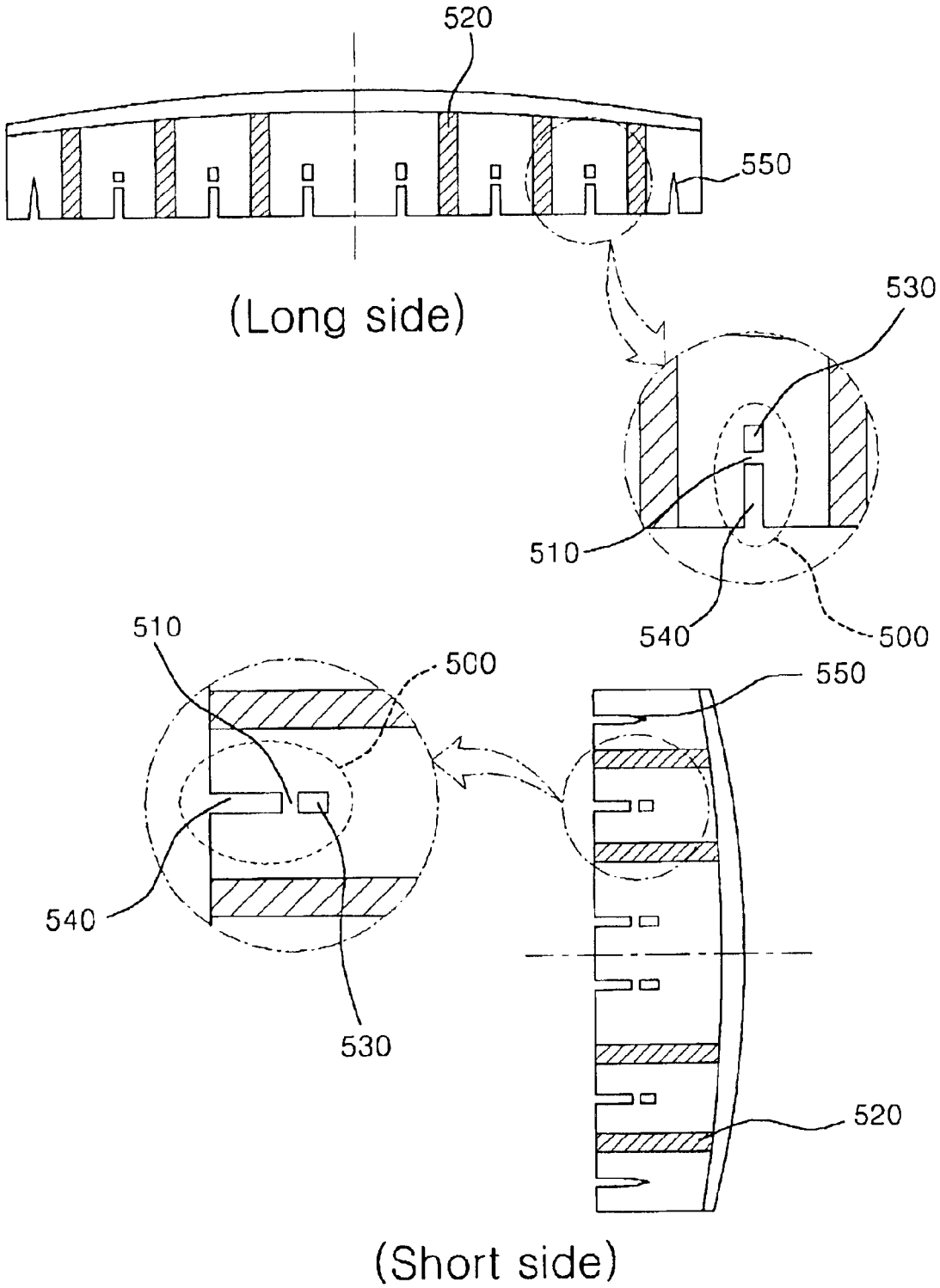
FIG. 6 is a side sectional view of long and short sides of a shadow mask according to another preferred embodiment of the present invention.

FIG. 6 is a side sectional view of long and short sides of a shadow mask according to another preferred embodiment of the present invention.

As a more particular embodiment of the present invention, the side sectional view of the long and short sides of the shadow mask in FIG. 6 show bridges added, as strength enhancing means, to the slits 500 in the skirt portion 130 of the shadow mask.

As can be seen from a more particular observation of the side sectional view of FIG. 6, a long portion having a prescribed thickness in the upper of the skirt portion and forming a slightly curved surface represents a shape of a curve surface of the shadow mask. In the skirt portion below the long portion, a pair of slits of a plurality of slits 500 are arranged at both sides of the center point of each of long and short sides of the skirt portion with a prescribed interval and the remaining of the plurality of slits 500 are arranged together the plurality of embossments 520 in an alternate and parallel manner, as shown in FIG. 6.

The plurality of slits 500 are separated into upper slits 530 and lower slits 540 to form bridges 510 having a prescribed shape. The plurality of slits 500 extend up to 30 to 70% of the entire height of the skirt portion from the end of the skirt portion. The plurality of embossments 520 extend over the entire height of the skirt portion from the end of the skirt portion and have an arch-shaped section and a shape indented into an inside from the skirt portion.

On the other hand, in order to prevent folding of a diagonal corner of the shadow mask when the shadow mask is formed, slits 550 at both ends of the long and short sides of the skirt portion are arranged without any bridge.

Figure 7:
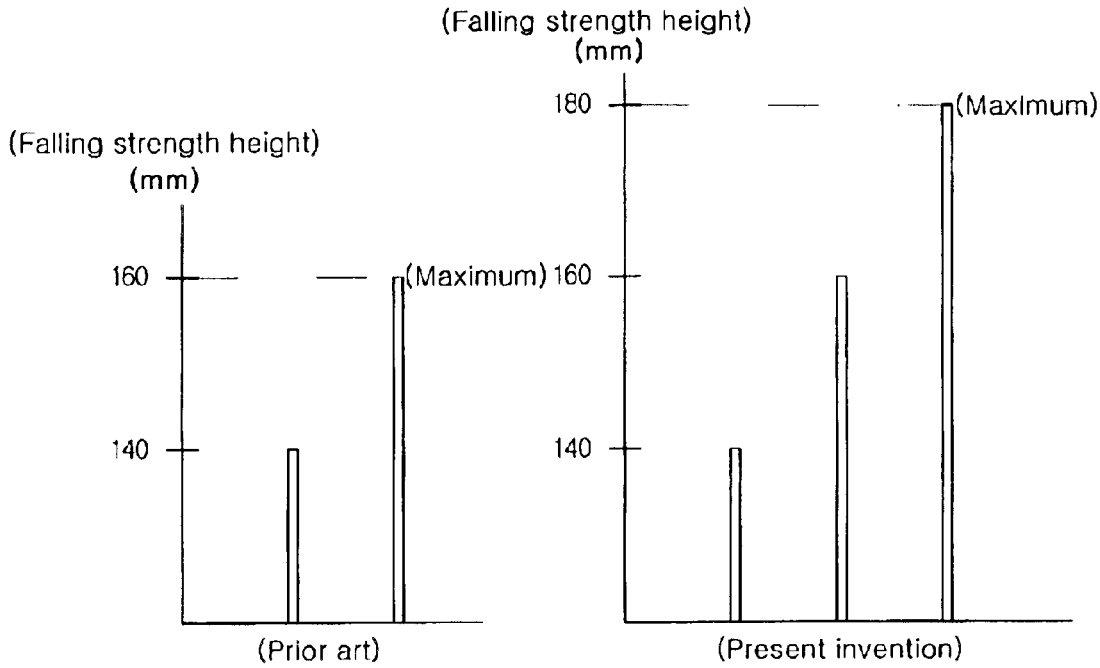
FIG. 7 is a graph showing an enhancement of strength of mask slits in the embodiment of FIG. 6.

FIG. 7 is a graph showing an enhancement of strength of mask slits in the embodiment of FIG. 6.

As can be seen from the graph of FIG. 7, while a conventional limit of maximal falling height at which mask slits are broken is 160 mm, a limit of maximal falling height at which mask slits are broken according to the present invention is 180 mm. That is, the limit of maximal falling height of slits of the present invention is higher 20 mm than that of the prior art in a characteristic estimation (impact test). This shows that the slits modified according to the present invention have high strength over the slits in the prior art.

On the other hand, several embodiments of a shape of slit in the present invention will be explained with reference to FIGS. 8 and 10.

Figure 8:
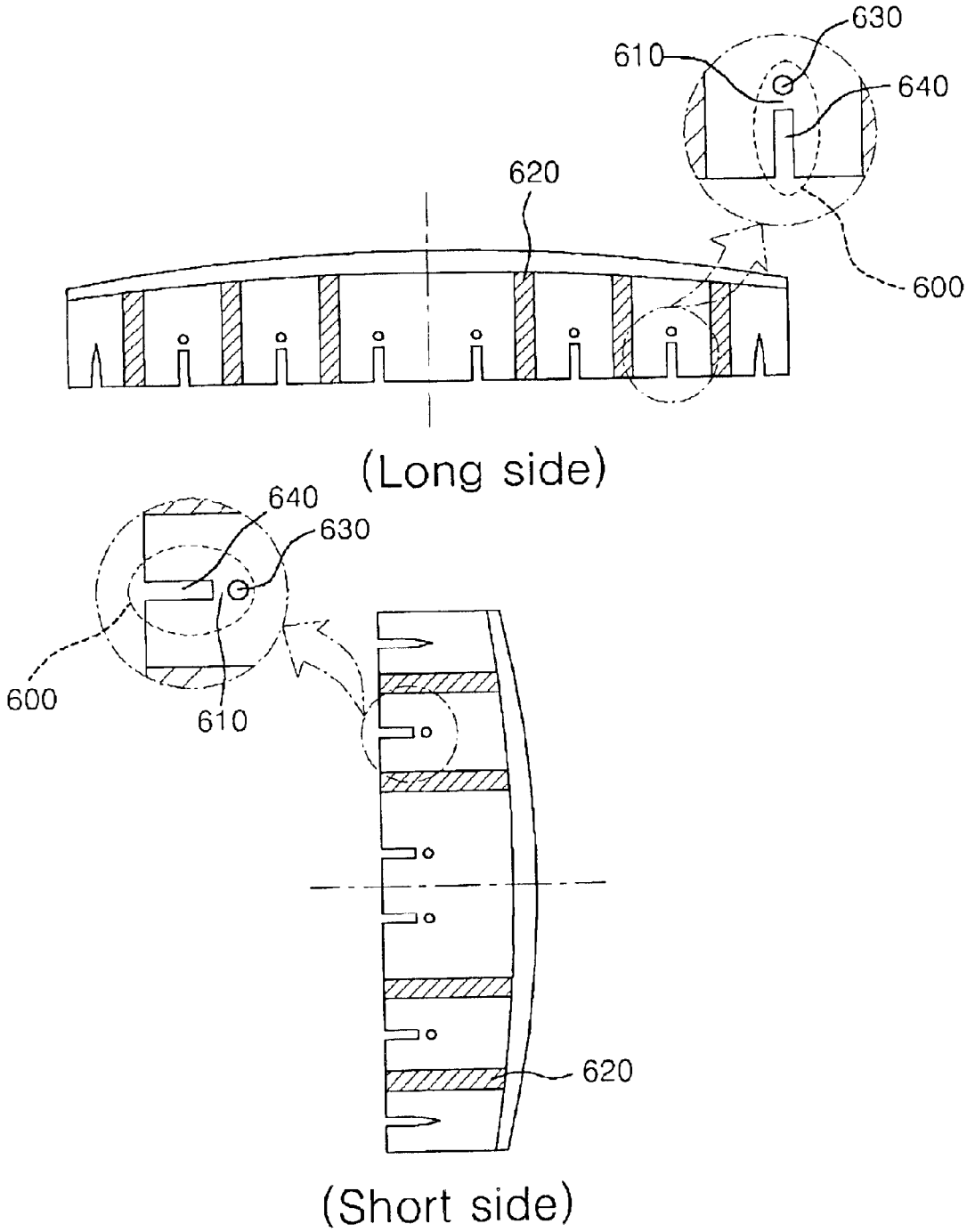
FIG. 8 is a view showing a first example of slits provided in a skirt portion of the shadow mask in the embodiment of FIG. 6.

FIG. 8 is a view showing circular slits provided in a skirt portion of the shadow mask in the embodiment of FIG. 6.

As can be seen from FIG. 8, the slits in the long and short sides of the skirt portion of the shadow mask are separated by bridges 610 into upper slits 630 having a circular shape and lower slits 640.

Figure 9:
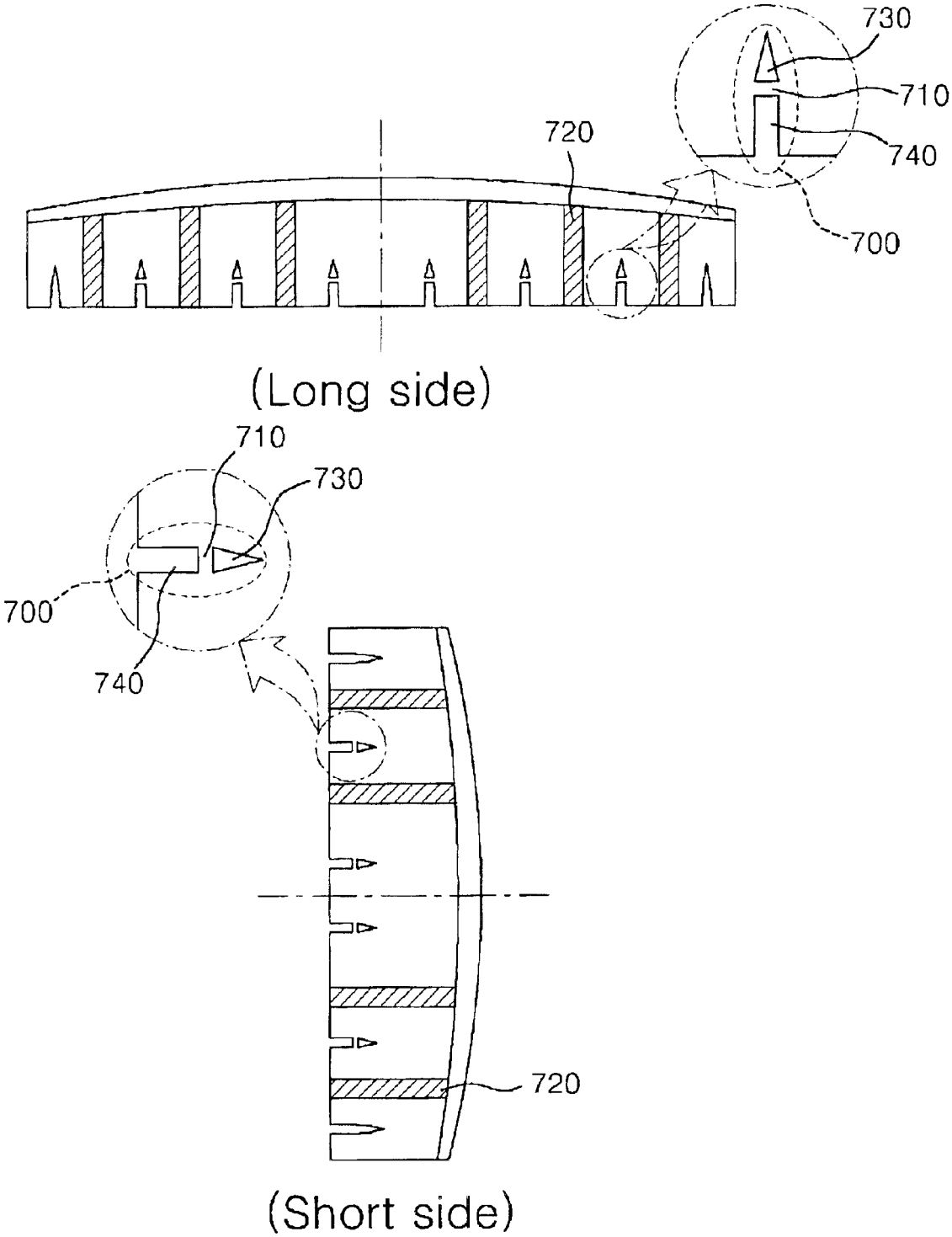
FIG. 9 is a view showing a second example of slits provided in a skirt portion of the shadow mask in the embodiment of FIG. 6.

FIG. 9 is a view showing triangular slits provided in a skirt portion of the shadow mask in the embodiment of FIG. 6.

As can be seen from FIG. 9, the slits in the long and short sides of the skirt portion of the shadow mask are separated by bridges 710 into upper slits 730 having a triangular shape and lower slits 740.

As described above, although the preferred embodiment of the present invention shown in FIG. 6 is for rectangular slits, the shape of the slits is not limited to that, but can be diversely formed as circular 630 or triangular 730, as shown in FIG. 8 or 9.

In addition, although the preferred embodiment of the present invention shown in FIG. 6 illustrates, as an example, the shadow mask including the skirt portion having a structure in which the slits forming six bridges are arranged in the long side of the skirt portion and the slits forming four bridges are arranged in the short side of the skirt portion in the alternate and parallel manner, such a structure can be varied depending on a size of a screen, and therefore, the principle of the present invention is applicable to a shadow mask for a color CRT having different number of the slits and/or embossments.

In addition, although not shown in the drawings, preferably, as another example, one embossments is located on the center axis of the long and short sides of the skirt portion.

In other words, it is possible to locate one of the plurality of embossments on the center axis in the long and short sides of the skirt portion of the shadow mask, arrange slits forming a pair of bridges at both sides of the center axis with a specific interval, and arrange the slits and the remaining embossments in the alternate and parallel manner.

In addition, it is preferred that the panel has a substantially flat outer surface and a curved inner surface.

<Still Another Preferred Embodiment>

Figure 10:
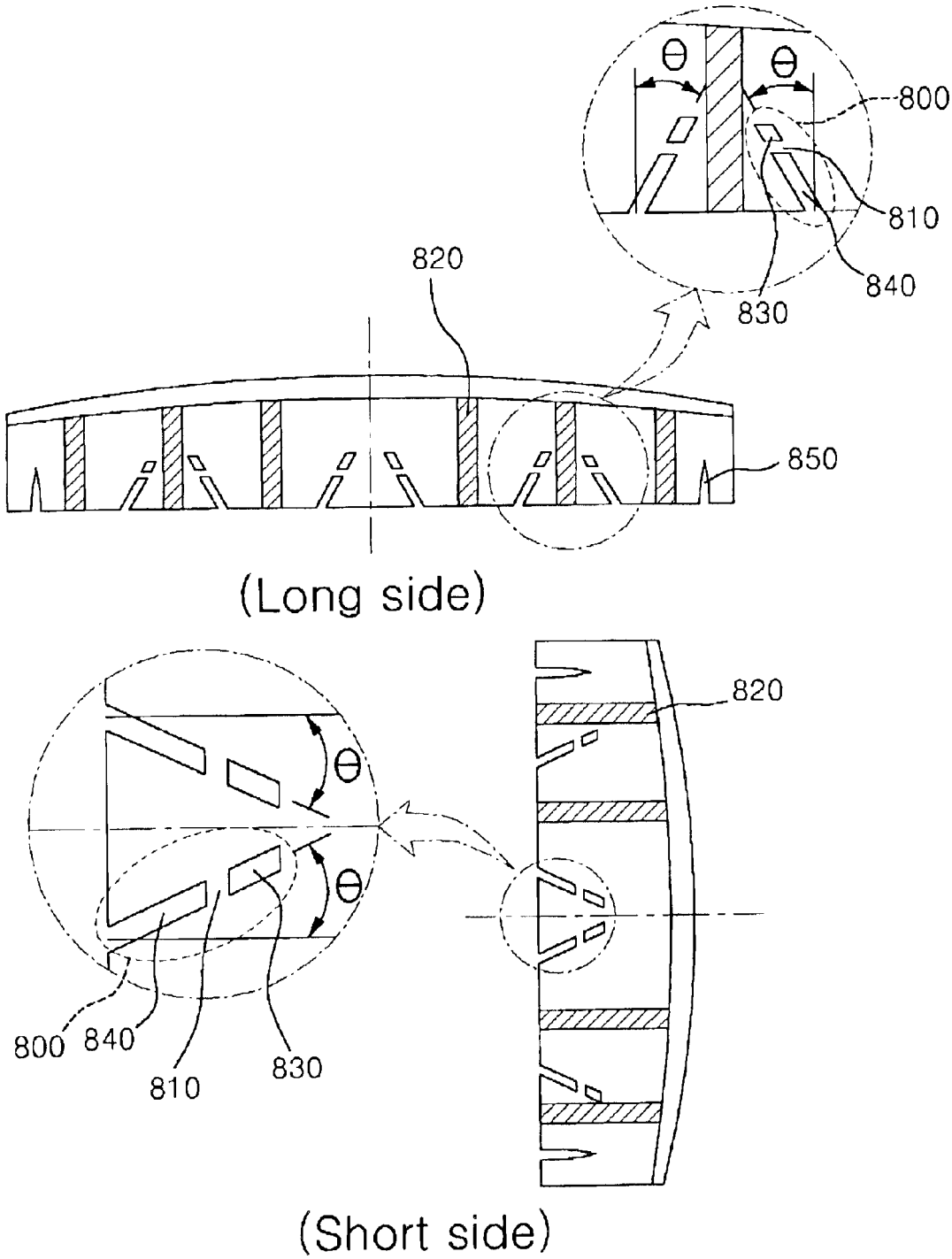
FIG. 10 is a side sectional view of long and short sides of a shadow mask according to still another preferred embodiment of the present invention.

FIG. 10 is a side sectional view of long and short sides of a shadow mask according to still another preferred embodiment of the present invention.

As shown in FIG. 10, still another preferred embodiment is characterized in that a plurality of slits 800 including the bridges 810 in the skirt portion 810 of the shadow mask 130 are inclined by a prescribed angle.

Herein, when the plurality of slits 800 are inclined, a pair of slits 800 are arranged to be inclined toward the center axis with respect to a direction of height of the skirt portion at both sides of the center axis of the long and short sides of the skirt portion with a specific interval. Also, a structure composed of one embossments 820 and a pair of slits 800 inclined toward the embossments 820 with respect to the direction of height of the skirt portion at both sides of the embossments 820 is arranged in parallel at both sides of the center axis with a prescribed interval.

In the other hand, in order to prevent folding of a diagonal corner of the shadow mask when the shadow mask is formed, slits 850 at both ends of the long and short sides of the skirt portion are arranged without any inclination and bridge.

In addition, the plurality of slits 800 are separated into upper slits 830 and lower slits 840 to form bridges 810 having a prescribed shape. The plurality of slits 800 extend up to 30 to 70% of the entire height of the skirt portion from the end of the skirt portion. The plurality of embossments 820 extend over the entire height of the skirt portion from the end of the skirt portion and have an arch-shaped section and a shape indented into an inside from the skirt portion.

In addition, if the prescribed angle θ of the plurality of slits 800 forming the bridges lies between 60° and 90° in the direction of an end portion of the skirt from the direction of height of the skirt of the shadow mask, when the skirt portion 130 of the shadow mask is bent, many creases occur in the slits and a remarkable improvement effect for the spring-back and the strength of the shadow mask cannot be achieved. However, if the angle θ of the slits 800 continues to be modified to lie between 0° and 60° in the direction of an end portion of the skirt from the direction of height of the skirt of the shadow mask, the shadow mask having a high strength, a reduced deformation and a reduced curl can be obtained when the shadow mask is formed. Such a structure has same strength as the structure in which the slits not inclined in the preferred embodiment of FIG. 6 are separated into the upper and lower slits to form the bridges.

Namely, when the slits forming the bridges are inclined with a prescribed angle to be selected from a range of 0° to 90° in the direction of an end portion of the skirt from the direction of height of the skirt of the shadow mask, the spring-back is reduced, the strength of the shadow mask is increased, and the curl of the skirt portion is reduced.

Figure 11:
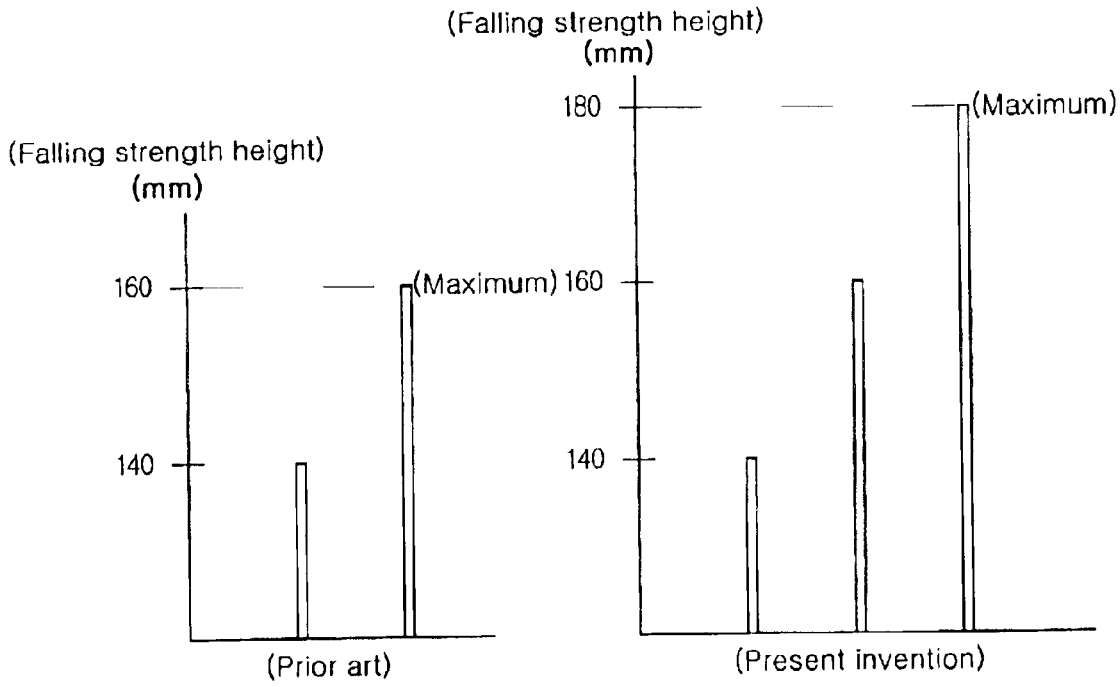
FIG. 11 is a graph showing an enhancement of strength of mask slits in the embodiment of FIG. 10.

FIG. 11 is a graph showing an enhancement of strength of mask slits in the embodiment of FIG. 10.

As can be seen from the graph of FIG. 11, while a conventional limit of maximal falling height at which mask slits are broken is 160 mm, a limit of maximal falling height at which mask slits are broken according to the present invention is 180 mm. That is, the limit of maximal falling height of slits of the present invention is higher 20 mm than that of the prior art in a characteristic estimation (impact test). This shows that the slits modified according to the present invention have high strength over the slits in the prior art.

On the other hand, several embodiments of a shape of slit in the present invention will be explained with reference to FIGS. 12 and 13.

Figure 12:
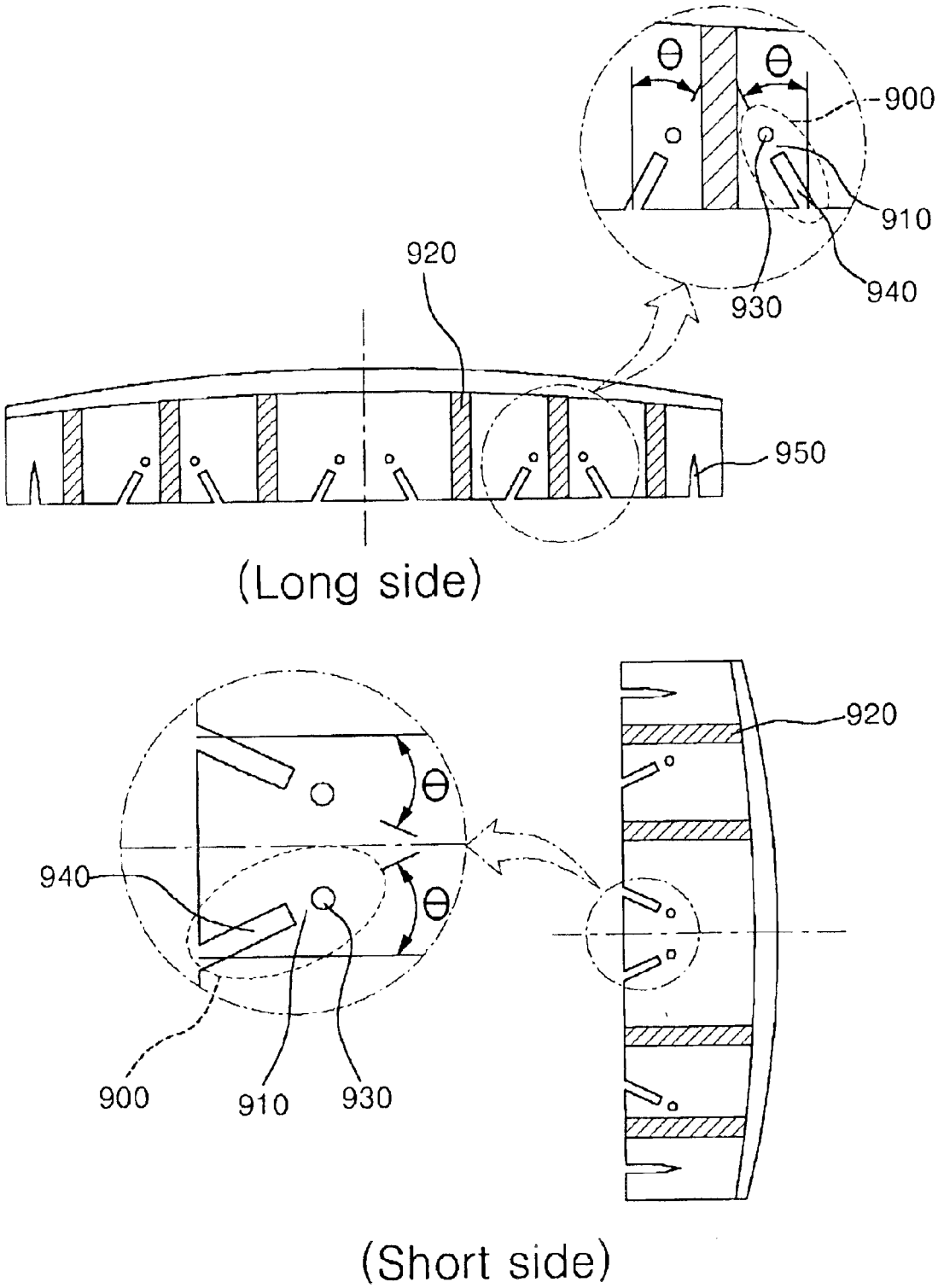
FIG. 12 is a view showing a first example of slits provided in a skirt portion of the shadow mask in the embodiment of FIG. 10.

As can be seen from FIG. 12, the slits in the long and short sides of the skirt portion of the shadow mask are separated by bridges 910 into upper slits 930 having a circular shape and lower slits 940.

Figure 13:
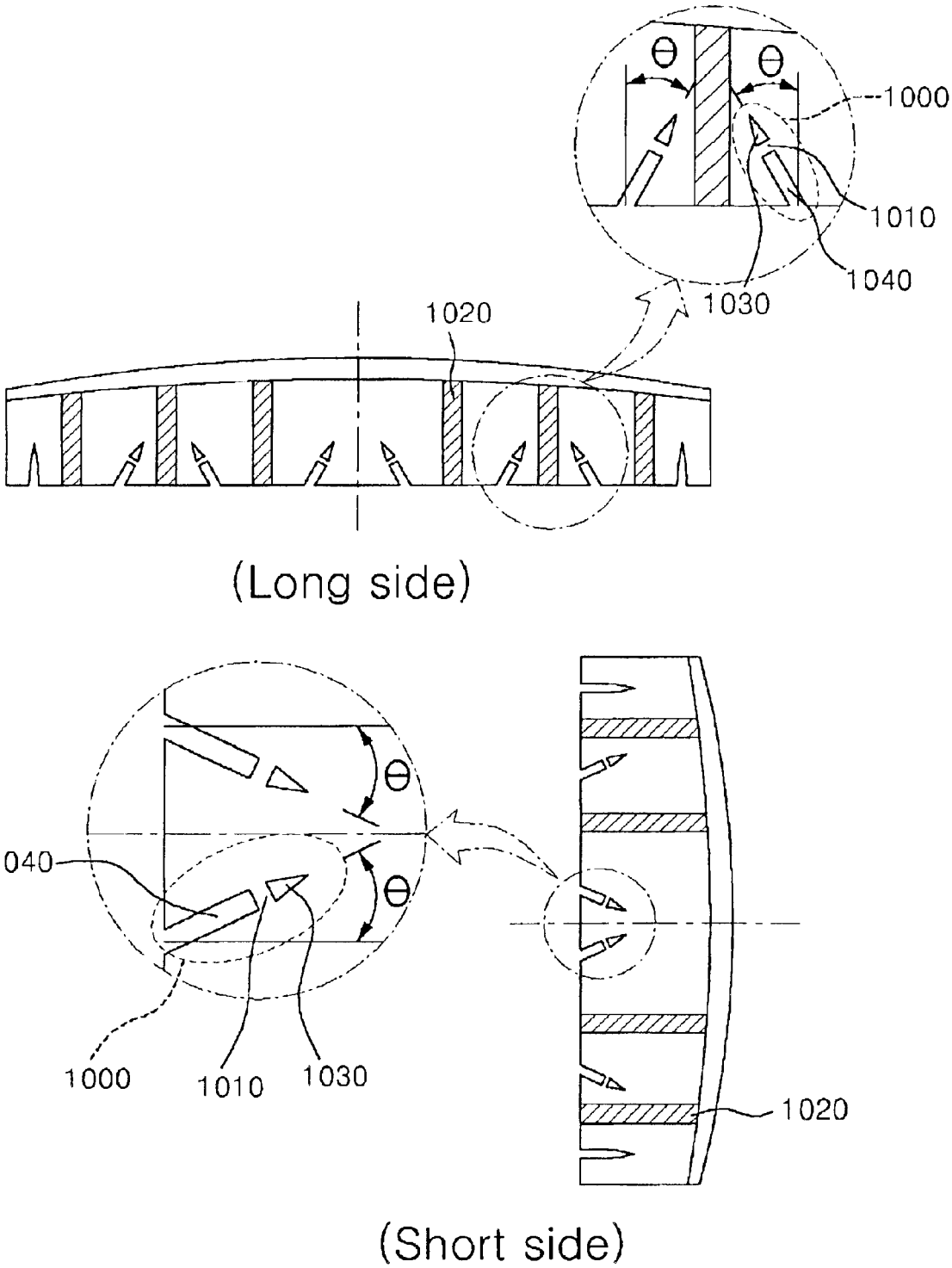
FIG. 13 is a view showing a second example of slits provided in a skirt portion of the shadow mask in the embodiment of FIG. 10.

In addition, as can be seen from FIG. 13, the slits in the long and short sides of the skirt portion of the shadow mask are separated by bridges 1010 into upper slits 1030 having a triangular shape and lower slits 1040.

As described above, although the preferred embodiment of the present invention shown in FIG. 10 is for rectangular slits, the shape of the slits is not limited to that, but can be diversely formed as circular 930 or triangular 1030, as shown in FIG. 11 or 12.

Although the preferred embodiment of the present invention shown in FIG. 10 illustrates, as an example, the shadow mask including the skirt portion having a structure in which the slits forming six bridges are arranged in the long side of the skirt portion and the slits forming four bridges are arranged in the short side of the skirt portion in the alternate and parallel manner, such a structure can be varied depending on a size of a screen, and therefore, the principle of the present invention is applicable to a shadow mask for a color CRT having different number of the slits and/or embossments.

In addition, although not shown in the drawings, preferably, as another example, one embossments is located on the center axis of the long and short sides of the skirt portion.

In other words, it is possible to locate one of the plurality of embossments on the center axis in the long and short sides of the skirt portion of the shadow mask, arrange slits forming a pair of bridges at both sides of the center axis with a specific interval, and arrange the slits and the remaining embossments in the alternate and parallel manner. In addition, it is possible to incline the slits forming the bridges located at both sides of the embossments on the center axis toward the embossments on the center axis with a prescribed angle between 0° and 60° in the direction of an end portion of the skirt from the direction of height of the skirt of the shadow mask and incline pairs of slits of the remaining slits toward adjacent embossments with a prescribed angle selected from the range of 0° to 60°, with the embossments centered, in the alternate and parallel manner.

In addition, it is preferred that the panel has a substantially flat outer surface and a curved inner surface.

As described above, by locating one of the plurality of embossments having a prescribed shape on the center axis of the long and short sides of the skirt portion of the shadow mask for the color CRT and arranging a pair of slits at both sides of the center axis to be symmetrically inclined toward the embossments on the center axis with a prescribed angle, the spring-back in the skirt portion can be reduced when the shadow mask is formed.

Accordingly, since the amount of curt generated in the curved portion of the skirt portion can be minimized so that a stress applied to the skirt portion when the skirt portion is fitted into the frame assembly does not propagate up to the porous portion or the nonporous portion, it is possible to prevent a distortion from being generated in the curved shape of the porous portion of the shadow mask.

In addition, by adding bridges to a plurality of slits and inclining the plurality of slits above an angle of 30° with one embossments centered, the amount of curl generated in forming the skirt portion by press can be reduced so that the skirt portion can be easily fixed to the mask frame. In addition, since a stress of the skirt portion fitted into the frame assembly is small, a distortion of contour of the curved shape of the porous portion can be prevented. As a result, a deterioration generated by hitting the electron beam on the shadow mask can be prevented, and accordingly, a selectivity for color become better and the strength of the shadow mask is further enhanced.

In addition, since a falling impact is dispersedly and sufficiently absorbed by the slits having a strengthened structure in the present invention, it is possible to reduce a deformation of the shadow mask generated since erected slits in the skirt portion of the shadow mask cannot properly disperse a load by an impact in the falling test as the reliability test in the conventional CRT. As a result, the problems in the prior art can be solved by increasing the strength of the shadow mask and sufficiently absorbing the shivering of the shadow mask in the acoustic impact test and hence reducing the shivering of the picture in the CRT.

Accordingly, color purity characteristic of the shadow mask becomes better and the strength of the shadow mask becomes enhanced, which results in improvement of productivity and reliability of products employing the shadow mask.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

For example, a shape of the slits and the embossments or an angle of the slits can be variously modified and practiced by those skilled in the art.

What is claimed is:

1. A color cathode ray tube including a generally rectangular shadow mask having a curved apertured portion having a multiplicity of electron-transmissive apertures, a curved imperforate portion surrounding and integral with said apertured portion and a skirt portion being bent back from a periphery of said curved imperforate portion;

said skirt portion being provided with a plurality of tilted slits and a plurality of embossments.

2. The color cathode ray tube according to claim 1, wherein a pair of slits among the plurality of tilted slits are placed at both sides of a center axis of the skirt portion and the remaining slits and the plurality of embossments are arranged in parallel such that the plurality of slits are tilted toward the center axis.

3. The color cathode ray tube according to claim 2, wherein one of the plurality of embossments is placed either on the center axis of a long side skirt portion or the center axis of a short side of the skirt portion.

4. The color cathode ray tube according to claim 1, wherein the plurality of tilted slits are tilted by 30° to 60° from the vertical position toward the direction of the end portion of the skirt portion of the shadow mask.

5. The color cathode ray tube according to claim 1, wherein the plurality of tilted slits are formed to cover 20% to 60% of the entire height of the skirt portion starting from the end portion of the skirt portion.

6. The color cathode ray tube according to claim 1, wherein the plurality of embossments are formed over the entire height of said skirt portion.

7. The color cathode ray tube according to claim 1, wherein the slits at both ends of the long or short side of the skirt portion are not tilted.

8. The color cathode ray tube according to claim 1, wherein the panel has a substantially flat outer surface and a curved inner surface.

9. A color cathode ray tube including a generally rectangular shadow mask having a curved apertured portion having a multiplicity of electron-transmissive apertures, a curved imperforate portion surrounding and integral with said apertured portion and a skirt portion being bent back from a periphery of said curved imperforate portion;

said skirt portion being provided with a plurality of tilted slits with bridge and a plurality of embossments.

10. The color cathode ray tube according to claim 9, wherein a pair of slits among the plurality of slits that form the bridges are placed at both sides of a center axis of the skirt portion and the remaining slits and the plurality of embossments are arranged in parallel.

11. The color cathode ray tube according to claim 10, wherein one of the plurality of embossments is placed either on the center axis of the long side skirt portion or the center axis of the short side of the skirt portion.

12. The color cathode ray tube according to claim 9, wherein the length of the plurality of embossments that are formed is the same as the entire height of said skirt portion.

13. The color cathode ray tube according to claim 9, wherein the plurality of slits forming bridges are formed to cover 30% to 70% of the entire height of the skirt portion of the shadow mask.

14. The color cathode ray tube according to claim 9, wherein the slits placed at the ends of the long or short side of the skirt portion are the slits having no bridge.

15. The color cathode ray tube according to claim 9, wherein among the plurality of slits forming the bridges, a shape of upper slits that are placed relatively further away from the end portion of the skirt portion is rectangular.

16. The color cathode ray tube according to claim 9, wherein among the plurality of slits forming the bridges, a shape of upper slits that are placed relatively further away from the end portion of the skirt portion is circular.

17. The color cathode ray tube according to claim 9, wherein among the plurality of slits forming the bridges, a shape of upper slits that are placed relatively further away from the end portion of the skirt portion is triangular.

18. The color cathode ray tube according to claim 9, wherein the plurality of slits forming bridges are tilted from the vertical position toward a direction of the end portion of the skirt portion.

19. The color cathode ray tube according to claim 9, wherein the panel has a substantially flat outer surface and a curved inner surface.

* * * * *